United States Patent [19]

Kubach

[11] Patent Number: 5,040,514

[45] Date of Patent: Aug. 20, 1991

[54] ARRANGEMENT FOR INJECTING FUEL FOR AN INTERNAL COMBUSTION ENGINE

[75] Inventor: Hans Kubach, Hemmingen, Fed. Rep. of Germany

[73] Assignee: Robert Bosch GmbH, Stuttgart, Fed. Rep. of Germany

[21] Appl. No.: 619,961

[22] Filed: Nov. 30, 1990

[30] Foreign Application Priority Data

Nov. 30, 1989 [DE] Fed. Rep. of Germany ..... 3939547

[51] Int. Cl.[5] ..... F02M 51/06

[52] U.S. Cl. ..... 123/490; 123/298; 123/590; 361/152; 361/159

[58] Field of Search ..... 123/298, 490, 590; 361/152, 154, 159

[56] References Cited

U.S. PATENT DOCUMENTS

| | | | |
|---|---|---|---|
| 4,167,158 | 9/1979 | Martin et al. | 123/590 X |
| 4,511,945 | 4/1985 | Nielsen | 123/490 X |
| 4,688,536 | 8/1987 | Mitsuyasu et al. | 123/490 |
| 4,706,619 | 11/1987 | Buchl | 123/490 X |
| 4,733,326 | 3/1988 | Harsch et al. | 123/490 X |
| 4,865,006 | 9/1989 | Nogi et al. | 123/590 |
| 4,930,040 | 5/1990 | Binarsch et al. | 361/154 |
| 4,950,974 | 8/1990 | Pagano | 123/490 X |

FOREIGN PATENT DOCUMENTS 0036188 9/1981 European Pat. Off. .

OTHER PUBLICATIONS

Bosch, Robert, "Maschinenmarkt", published by Vogel Verlag Würzburg, vol. 72, 9-1985, pp. 1419-1421.

*Primary Examiner*—Willis R. Wolfe
*Attorney, Agent, or Firm*—Walter Ottesen

[57] ABSTRACT

An arrangement for injecting fuel for an internal combustion engine has at least one inductive injection valve which is switch controlled via a controllable semiconductor switch. This injection valve is provided with an inductive or capacitive oscillator component for atomizing fuel. During the switching control operation, electrical energy from the inductive injection valve is fed into the oscillator component for exciting its oscillating movement each time the semiconductor switch is opened. On the one hand, with this arrangement no separate high frequency generator is required for the oscillator component while, on the other hand, a second transistor is not required for the switch-controlled output stage with a rapid discharge without loss being possible at least in principle.

19 Claims, 3 Drawing Sheets

ARRANGEMENT FOR INJECTING FUEL FOR AN INTERNAL COMBUSTION ENGINE

FIELD OF THE INVENTION

The invention relates to an arrangement for injecting fuel for an internal combustion engine. The arrangement has at least one inductive injection valve switch-controlled via a controllable semiconductor switch.

BACKGROUND OF THE INVENTION

Switch-controlled output stages for inductive consumers such as injection valves are known. These switch-controlled output stages operate by controlling the excitation current for the inductive consumer in a clocked manner after reaching a nominal value to maintain the excitation. In the so-called half-current region, the control switch is repeatedly switched closed when the current has dropped to a predetermined minimal value. This affords the advantage that the operation takes place with a single voltage source and that the control switch configured as a semiconductor switch operates strictly in a switching operation. However, with an injection valve in the context of a switch-controlled output stage, the problem occurs that the current should be reduced very rapidly when switching off the valve; whereas, the holding current during holding current operation should only drop slowly. In order to achieve this condition, a first semiconductor switch provides a clocked current supply to the magnetic valve; whereas, a second semiconductor switch, during holding current operation, conducts the current via a diode during intermittent cutoff of the first semiconductor switch. If the control current of the magnetic valve is to be switched off entirely, then both transistors block and a rapid discharge takes place via the Zener diode. A rapid discharge would lead to large losses if the holding current were still flowing. The cost of components and the cost of an output stage switch-controlled in this manner is correspondingly very high.

The preparation of the fuel in the intake pipe is important for gasoline injection especially for a good cold start. The conventional preparation as the fuel discharges from a nozzle or from a slit does not satisfy all requirements even for high pressure and the narrowest slits. For this reason, the suggestion has already been made to provide an additional atomization of the discharging fuel by means of ultrasonic oscillation. Examples are provided in European published patent application 0,036,118 and in the technical journal "Maschinenmarkt", volume 72, starting at page 1420, (1985). In these publications, piezoelectric ultrasonic oscillators for atomizing fuel are described and are mounted at the discharge opening of a magnetic or inductive injection valve. The oscillations atomize the fuel jet discharging at the opening of the valve into a fine mist. An external HF-generator is utilized for driving the piezoelectric oscillator which makes this kind of a system complex and expensive.

SUMMARY OF THE INVENTION

The arrangement of the invention affords the advantage with respect to the foregoing in that a cost-favorable atomization of the fuel discharging from the injection valve is obtained by the combination of a switch-controlled output stage and an inductive or capacitive oscillator component because the output stage together with the injection valve is utilized as an oscillator for the oscillator component so that an additional generator is eliminated. In addition, a second semiconductor switch or transistor is eliminated in the switch-controlled output stage since, during holding current operation, the energy stored in the injection valve is applied periodically to the oscillator component for exciting the latter. The rapid discharge takes place by means of the rapid transfer of the energy stored in the injection valve into the oscillator component. In this way, the holding current operation as well as the rapid discharge during operation is free of loss. The energy is fed back again into the injection valve because of the oscillation.

The energy fed from the injection valve into the oscillator component preferably takes place via a semiconductor component which, in the simplest embodiment, is configured as a diode. For increasing the oscillating energy, the semiconductor component can also be a controllable semiconductor element which is actuated in opposition to the semiconductor switch.

A very simple circuit of the controllable output stage utilized as an oscillator results by connecting the controllable semiconductor switch and the inductive injection valve connected in series therewith between the poles of a direct-current source with the semiconductor element connecting the circuit node between the semiconductor switch and the injection valve to the oscillator component. A very small number of cost-effective components in this way lead to the desired solution, that is, a combination of a switch-controlled output stage and an ultrasonic atomization.

A configuration which is very simple with respect to its circuit is provided when the capacitive oscillating member is configured as a piezoelectric oscillator and defines a series circuit together with an inductive component and with this series circuit being connected between the poles of a direct-current source. As an alternative, and in lieu of a piezoelectric oscillator or a piezoelectric ceramic, an oscillatory excitation can occur via magnetostriction with a magnetostrictive oscillator being provided which is connected in series with a capacitive component.

An especially advantageous solution is provided in that the capacitive oscillation component configured as a piezoelectric oscillator is connected between the semiconductor element and the pole of the direct-current source connected to the injection valve and that a biasing component is connected in parallel with the oscillating component. The biasing component applies a biasing voltage to the inductive component and is connected in series with this inductive component. In this way, a higher oscillating energy can be obtained in that, without an additional controllable semiconductor switch, the diode can be switched in opposition to the semiconductor switch controlling the injection valve (blocking or conductive). The maximum alternating-voltage amplitude is therefore completely utilized in the steady-state condition, that is, during the holding current operation, for generating the oscillation.

As an alternative, a magnetostrictive oscillator can be utilized in lieu of the inductive component and in lieu of the piezoelectric oscillator, a capacitive component or a capacitor can be used.

The biasing component is preferably configured as a parallel circuit of a Zener diode having a capacitor. In a simpler embodiment, even a simple resistor can be utilized in lieu of the Zener diode.

Because the resonance characteristics of the last-mentioned embodiment are very significant, the driving of the semiconductor switch can also be synchronized via positive feedback to the resonance circuit.

In order that the oscillation of the oscillator component is available already at injection start, the inductive injection valve can be charged with a biasing current in advance of injection start with this biasing current corresponding essentially to or being less than the holding current since the magnetic valve has a large switching hysteresis.

The advantage of the arrangement described above is also seen in that the simple possibility is provided that the components can be accommodated in the injection valve so that not a single further lead is required for the remaining electronics of the vehicle. Only a single additional lead is required if all components except the oscillator are accommodated in the electronics.

Because of high costs, the switch-controlled output stages are only utilized in a limited manner notwithstanding its technical advantages. The components and costs are significantly reduced with the arrangement of the invention described above. For this reason, a practical and economic realization is no longer restricted.

BRIEF DESCRIPTION OF THE DRAWINGS

The invention will now described with reference to the drawings wherein.

DESCRIPTION OF THE PREFERRED EMBODIMENTS OF THE INVENTION

Figure 1:
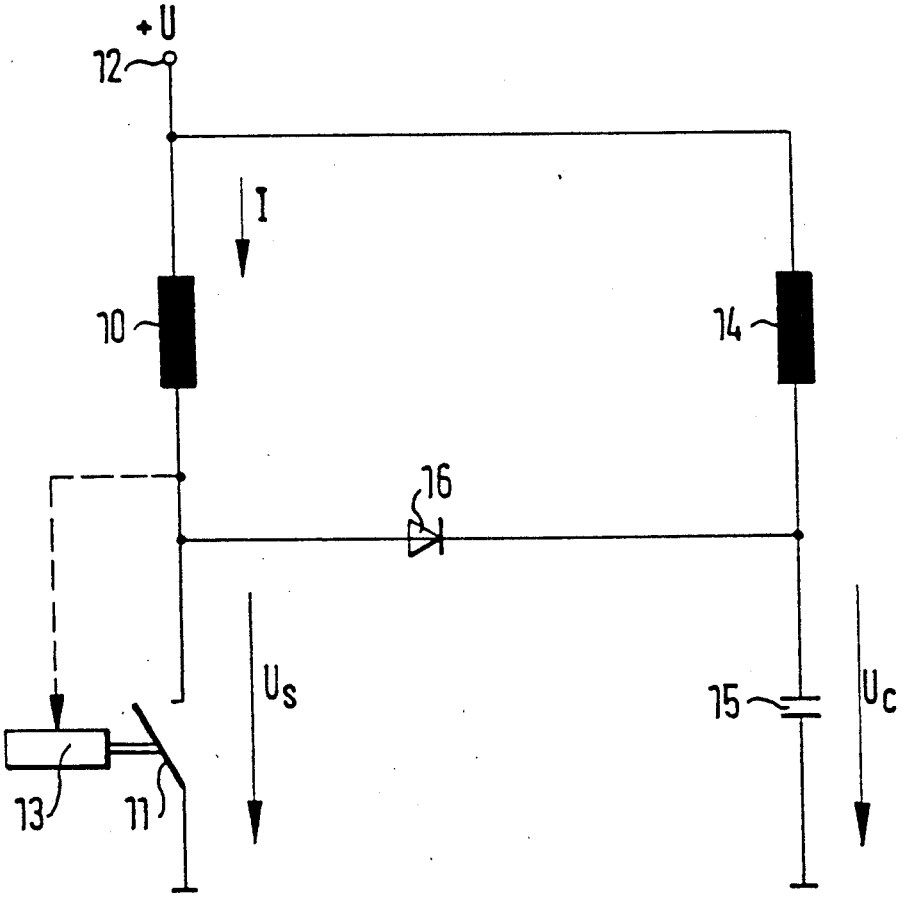
FIG. 1 is a circuit diagram of a first embodiment of the invention.

In the embodiment of FIG. 1, a magnetic or inductive injection valve 10 is connected in series with a controllable semiconductor switch 11 which, for example, can be configured as a transistor connected between the positive pole 12 of a direct-current source U and ground. A control circuit 13 for the current-dependent control of the semiconductor switch 11 acts on the control input of the switch 11 and closes the semiconductor switch 11 in the usual manner when there is a drop below a first pregiven current value and opens the semiconductor switch 11 when a second higher current value is exceeded. These current values are so selected that the injection valve 10 reliably opens before reaching the higher current value and remains open during reduction of the current until the lower current value is reached.

An inductive component 14 is configured, for example, as a coil and a series circuit of the inductive component 14 and a piezoelectric oscillator 15 is likewise connected between the positive pole 12 and ground with the piezoelectric oscillator 15 being connected to ground. The circuit node 2 of the first series circuit is connected via a diode 16 to the circuit node 4 of the second series circuit.

The injection valve 10 is mounted in the intake pipe of an internal combustion engine in a manner not shown; whereas, the piezoelectric oscillator 15 is mounted at the discharge opening of an injection valve in order to atomize the discharging fuel jet into a fine mist.

Figure 3:
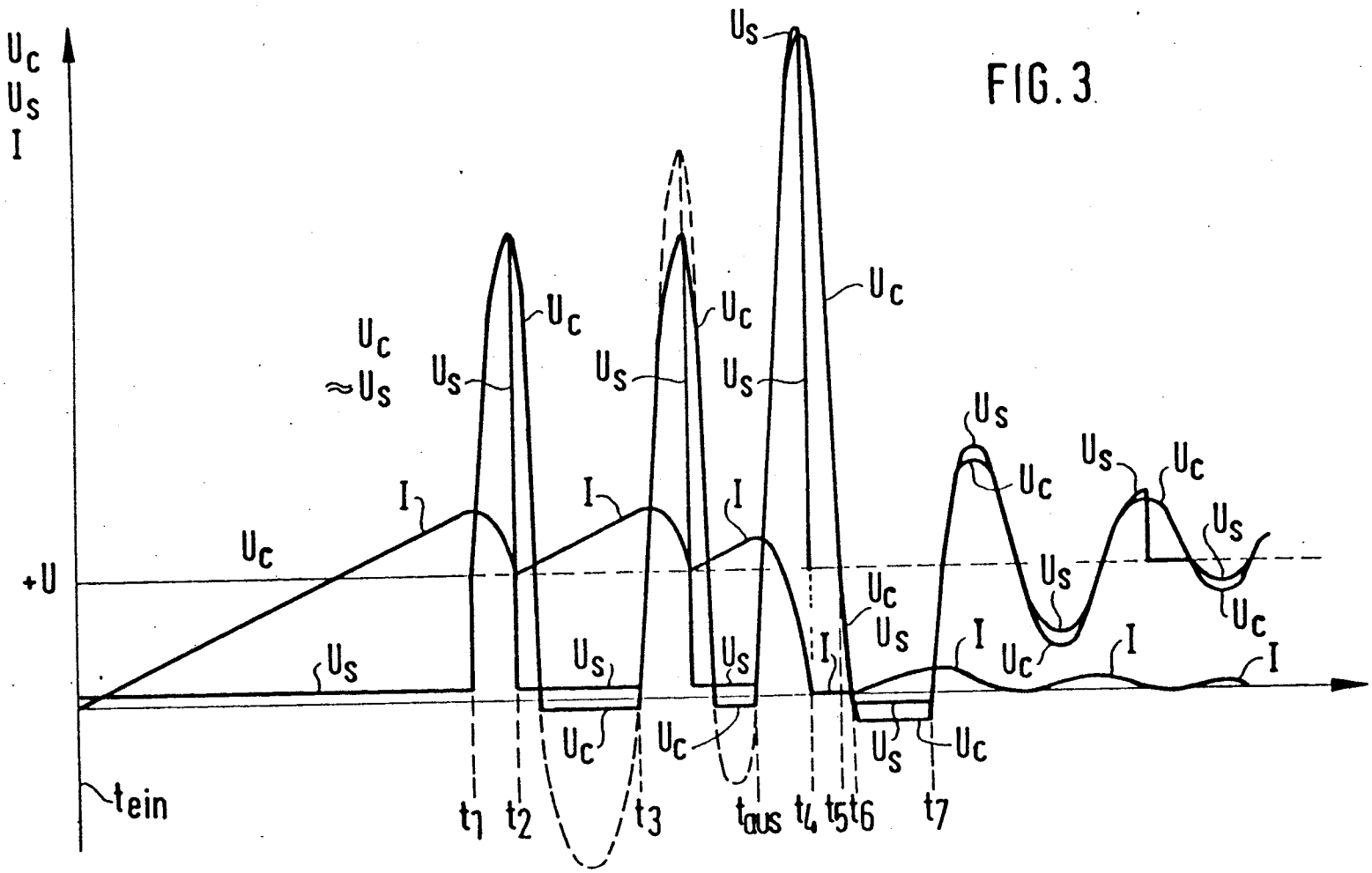
FIG. 3 is a waveform for explaining the operation of the invention.

The operation of the first embodiment shown in FIG. 1 will be described with respect to the signal waveforms shown in FIG. 3.

When the control circuit 13 or the voltage is switched on, the semiconductor switch 11 closes and the current I through the injection valve 10 begins to increase to the maximum value of current. When this value is reached, then the semiconductor switch 11 opens at time point $t_1$. The voltage $U_c$ on the piezoelectric oscillator 15 increases rapidly because of the current flow from the magnetic valve 10 via the diode 16 to the piezoelectric oscillator 15. The energy in the injection valve 11 is in part transmitted to the piezoelectric oscillator 15 and excites the piezoelectric oscillator 15 into oscillation. The current I through the injection valve 10 drops because of this action. The injection valve 10 is opened at this time point, the opening operation took place in advance of reaching the upper current limit value.

At the time point $t_2$, the current I has dropped to the lower limit value which still defines a permissible value at which the injection valve does not yet close; however, a condition is reached at which it would drop after a switch off in a short tolerable time. At the time point $t_2$, that is when this lower limit value is reached, the semiconductor switch 11 again closes and the current I begins again to increase. The diode 16 blocks and the voltage $U_c$ at the piezoelectric oscillator 15 drops rapidly since a discharge through the inductive component 14 takes place. When a maximum voltage $U_c$ is reached which is substantially greater than the voltage of the direct-current source, the entire energy which has reached the piezoelectric oscillator 15 between the time points $t_1$ and $t_2$, is again fed back to the direct-current source via the inductive component 14. When the voltage $U_c$ reaches approximately the value 0, the diode 16 again becomes conductive so that a further reduction of voltage in the piezoelectric oscillator 15 is not possible.

The second oscillating cycle starting at the time point $t_3$ at which the semiconductor switch 11 again opens, corresponds to the first cycle. Finally, at the time point $t_{aus}$, the semiconductor switch is finally opened in order to close the injection valve 10. The current I drops and reaches the value 0 at time point $t_4$. The voltage $U_c$ injection valve 10 is supplied. At a predetermined time point dependent upon the configuration of the injection valve 10, the valve 10 closes during the reduction in current and when the value 0 is reached, the diode 16 blocks. In this way, the voltage $U_c$ drops rapidly because of the feedback of the energy in the piezoelectric oscillator 15 and at a time point $t_5$ drops below the voltage of the direct-current source so that a current I again begins to flow through the diode 16. At the time point $t_6$, the voltage $U_c$ is limited at the value zero or at a slightly negative value since the semiconductor switch 11 generally conducts also at negative voltages.

Decaying oscillations of the piezoelectric oscillator 15 continue. At time point $t_7$, the current I again drops whereby $U_c$ and $U_s$ again increase rapidly according to the cycles described above. If $U_s$ becomes greater than the voltage U of the direct-current source, then the current I again drops. The decaying oscillation because of the feedback of the oscillator loop energy in the oscillator loop pregiven by the described components finally leads to the condition that the voltages $U_s$ and $U_c$ meet at the value U. The decaying oscillation is noncritical since this oscillation has reliably decayed in the long time duration for the short switch-on pulses which are critical for the linearity. The voltage $U_c$ is always positive and does therefore not depolarize the piezoelectric ceramic of the piezoelectric oscillator.

As an alternative to the embodiment just described, the piezoelectric oscillator 15 and the inductive component 14 can also be arranged so as to exchange places with the inductive component 14 being unnecessary in a simple embodiment. The function changes in the alternative embodiment of the piezoelectric oscillator 15 compared to FIG. 3 in that the voltage U of the direct-current source is subtracted from the voltage $U_c$ so that $U_c$ now defines an alternating voltage with the danger of a depolarization of the piezoelectric ceramic. For this purpose, the passive electronic components can be accommodated on a circuit board with the same number of conductors in the connecting cable.

In addition, in both embodiments, the inductive component 14 can be configured as a magnetostrictive oscillator for generating the ultrasonic oscillations. In this case, a capacitive component or a condenser can be utilized in lieu of the piezoelectric oscillator 15.

To increase the oscillator energy supplied to the piezoelectric oscillator 15 during the switching control, the condition must be prevented that the voltage $U_c$ is maintained constant in the region of zero during the open condition of the semiconductor switch 11. This is the case, for example, in the range between $t_2$ and $t_3$. In order to prevent holding the voltage $U_c$ in the region of zero, the diode 16 must be blocked in this region. This can, for example, take place in that a controllable semiconductor switch is utilized in lieu of the diode 16 with the semiconductor switch being controlled in opposition to the semiconductor switch 11. In this way, the voltage $U_c$ can oscillate into the negative range so that in the half period which follows, the amplitude increases whereby an increased oscillation energy is obtained. This is indicated in FIG. 3 by the broken lines. It is here a disadvantage that a second controllable semiconductor switch is required. With the circuit shown in FIG. 2 as the second embodiment, a second controllable semiconductor switch is not needed when increasing the oscillating energy.

Figure 2:
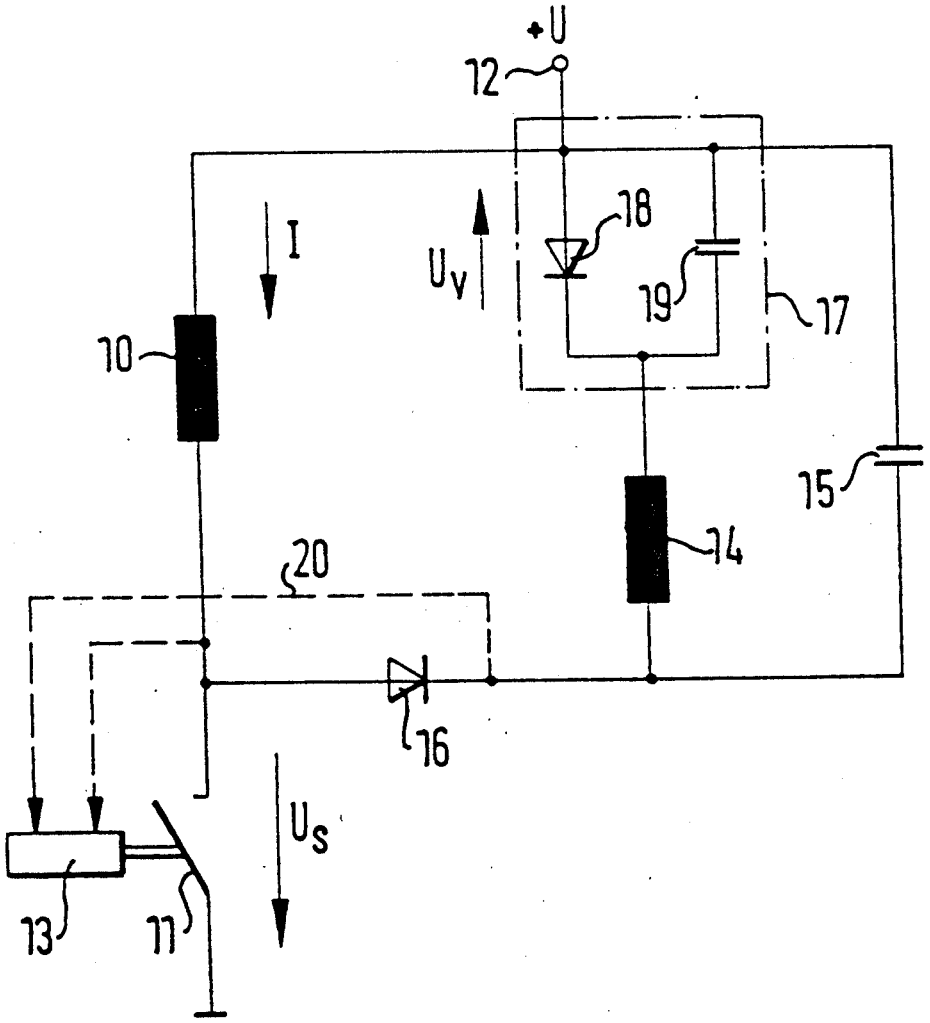
FIG. 2 is a circuit diagram of a second embodiment of the invention.

The second embodiment shown in FIG. 2 is configured in a manner similar to the first embodiment and the same or like acting components have the same reference numerals and are therefore not described again. In contrast to the first embodiment, the piezoelectric oscillator 15 is connected between the cathode of the diode 16 and the positive pole 12 of the direct-current source. The series circuit of the inductive component 14 and a biasing component 17 is connected in parallel to the piezoelectric oscillator 15. The biasing component 17 comprises the parallel circuit of a Zener diode 18 and a capacitor 19.

The operation corresponds in principle to the operation of the first embodiment; however, the voltage $U_v$ is preapplied to the inductive component 14 so that the diode 16 is blocked in opposition to the semiconductor switch 11; that is, for example, in the range between $t_2$ and $t_3$ or between $t_6$ and $t_7$. In this way, a similar operation is obtained as if a controllable semiconductor switch would be provided in lieu of the diode 16. The voltage $U_v$ results from the voltage drop across the Zener diode 18 of the flowing direct-current component. The alternating current component is short circuited by the capacitor 19. In this way, relationships are provided as shown by the broken lines in FIG. 3. The maximum alternating-current amplitude is completely utilized in the switch-control condition of the injection valve 10 so that the piezoelectric oscillator 15 oscillates with increased oscillating energy.

Since the resonance characteristics of this system are very pronounced, the drive of the controllable semiconductor switch 11 can be synchronized to the resonance loop via positive feedback. This is indicated by the broken line 20.

In this embodiment too, the magnetostriction can be applied for generating the ultrasonic oscillation; that is, the inductive component 14 can be configured as a magnetostrictive oscillator while the piezoelectric oscillator 15 can then be configured as a capacitor. Both types of oscillating components can also be provided.

In order to have the oscillation of the piezoelectric oscillator 15 available already at injection start, the current I can be brought to a biasing current already in advance of the switch-on time point of the injection valve 10. The biasing current can be generated by clocking the semiconductor switch 11 and can be as high as the holding current since magnetic valves have a large switching hysteresis.

It is understood that the foregoing description is that of the preferred embodiments of the invention and that various changes and modifications may be made thereto without departing from the spirit and scope of the invention as defined in the appended claims.

What is claimed is:

1. An arrangement for injecting fuel for an internal combustion engine, the arrangement comprising:

an inductive injection valve for injecting fuel for the engine;

energy supply means for supplying electrical energy to said injection valve;

oscillator means generating oscillations to atomize the fuel emitted from said injection valve;

a semiconductor switch connected to said injection valve to define a circuit therewith;

control means for controlling said switch to open and close said switch; and, circuit means connected between said injection valve and said oscillator means for conducting said electrical energy from said injection valve to said oscillator means for exciting said oscillations when said semiconductor switch is opened.

2. The arrangement of claim 1, said circuit means being a semiconductor component.

3. The arrangement of claim 2, said semiconductor component being a diode.

4. The arrangement of claim 1, said circuit means including a controllable semiconductor element controllable in opposition to said semiconductor switch.

5. The arrangement of claim 2, said energy supply means being a direct-current voltage source having first and second poles; said circuit defined by said injection valve and said semiconductor switch being a series circuit connected between the poles of said voltage source; said series circuit including a circuit node between said injection valve and said semiconductor switch; and, said semiconductor component being connected between said circuit node and said oscillator means.

6. The arrangement of claim 5, said oscillator means being a piezoelectric oscillator connected between said semiconductor component and one of said poles of said energy supply means.

7. The arrangement of claim 6, further comprising an inductive component connected to said piezoelectric oscillator to conjointly define a second series circuit therewith likewise connected between said poles of said voltage source.

8. The arrangement of claim 5, said oscillator means being a magnetostrictive oscillator and said arrangement further comprising a capacitive component connected to said magnetostrictive oscillator to conjointly define a second series circuit therewith likewise connected between said poles of said voltage source.

9. The arrangement of claim 5, said oscillator means being a piezoelectric oscillator and said injection valve being connected to said first pole of said voltage source; said piezoelectric oscillator being connected between said first pole and said semiconductor component; and, said arrangement further comprising: an inductive component and a biasing component for applying a biasing voltage to said inductive component; said inductive component and said biasing component conjointly defining an additional series circuit connected in parallel with said piezoelectric oscillator.

10. The arrangement of claim 9, said biasing component being a circuit including a Zener diode and a capacitor connected in parallel with said Zener diode.

11. The arrangement of claim 9, said biasing component being a circuit including a resistor and a capacitor connected in parallel with said resistor.

12. The arrangement of claim 9, further comprising means for providing positive feedback from said oscillator to said semiconductor switch.

13. The arrangement of claim 5, said oscillator means being a magnetostrictive oscillator and said injection valve being connected to said first pole; and, said arrangement further comprising: a biasing component for applying a biasing voltage to said oscillator; said biasing component and said oscillator conjointly defining an additional series circuit connected between said semiconductor component and said first pole; and, a capacitive component connected in parallel with said additional series circuit.

14. The arrangement of claim 13, said biasing component being a circuit including a Zener diode and a capacitor connected in parallel with said Zener diode.

15. The arrangement of claim 13, said biasing component being a circuit including a resistor and a capacitor connected in parallel with said resistor.

16. The arrangement of claim 1, wherein said inductive injection valve has a predetermined holding current; and, said arrangement further comprises means for applying a biasing current to said valve in advance of injection start which corresponds substantially to said holding current.

17. The arrangement of claim 1, wherein said inductive injection valve has a predetermined holding current; and, said arrangement further comprises means for applying a biasing current to said valve in advance of injection start which is less than said holding current.

18. The arrangement of claim 1, said oscillator means being a capacitive component.

19. The arrangement of claim 1, said oscillator means being an inductive component.

* * * * *

UNITED STATES PATENT AND TRADEMARK OFFICE

CERTIFICATE OF CORRECTION

PATENT NO. : 5,040,514

DATED : August 20, 1991

INVENTOR(S) : Hans Kubach

It is certified that error appears in the above-identified patent and that said Letters Patent is hereby corrected as shown below:

In column 4, line 43, after "$U_c$" insert -- increases still further since still more energy from the --.

Signed and Sealed this

Fourth Day of May, 1993

Attest:

Michael K. Kirk

MICHAEL K. KIRK

Attesting Officer

*Acting Commissioner of Patents and Trademarks*